United States Patent [19]

Steele

[11] Patent Number: 4,461,457

[45] Date of Patent: Jul. 24, 1984

[54] PUSH TO PULL FORCE CONVERTER

[76] Inventor: Elmer Steele, 2735 Headleys Mill Rd., SW. Rte. 1, Pataskala, Ohio 43062

[21] Appl. No.: 370,353

[22] Filed: Apr. 21, 1982

[51] Int. Cl.[3] ..... B66F 11/04

[52] U.S. Cl. ..... 254/93 R; 72/705

[58] Field of Search ..... 72/705; 29/239, 252, 29/227; 254/228, 231, 93 R, 100, 10.5

[56] References Cited

U.S. PATENT DOCUMENTS

| | | | |
|---|---|---|---|
| 2,165,503 | 7/1939 | Pfauser | 72/705 |
| 2,383,061 | 8/1945 | Johnson | 254/228 |
| 2,835,154 | 5/1958 | Geller | 72/705 |
| 2,948,057 | 8/1960 | Dagenais | 254/10.5 |
| 3,224,730 | 12/1965 | Fischler . | |
| 3,492,855 | 2/1970 | Wylie | 72/705 |
| 3,518,864 | 7/1970 | Pietronuto et al. . | |
| 3,749,364 | 7/1973 | Sanchez . | |
| 3,891,187 | 6/1975 | Bearden . | |

FOREIGN PATENT DOCUMENTS 1332498 10/1973 United Kingdom .

*Primary Examiner*—Robert C. Watson

*Attorney, Agent, or Firm*—Donald A. Kettlestrings

[57] ABSTRACT

Apparatus for converting the pushing action of a hydraulic piston-cylinder assembly to a pulling action. First and second substantially parallel rails are connected together adjacent to first ends thereof, and the rails are attached to a stationary reference object. First and second substantially parallel bars are connected together by guide means, and the guide means are in operative relationship with the bars and the rails for slidably positioning and guiding the first rail and the first bar in face-to-face relationship with respect to each other and for slidably positioning and guiding the second rail and the second bar in face-to-face relationship with respect to each other. Piston-cylinder assembly receiving means are in operative relationship with the rails and the bars for receiving and supporting a conventional piston-cylinder assembly and for enabling the rails and bars to move relative to one another to shorten the combined length of the apparatus.

10 Claims, 5 Drawing Figures

PUSH TO PULL FORCE CONVERTER

This invention relates to apparatus for converting the pushing action of a hydraulic piston-cylinder assembly to a pulling action.

Repair of collision damage to vehicles requires the use of large pulling forces. In the past, hydraulic piston-cylinder units or assemblies have been used to exert pulling forces in the repair of vehicles. For example, U.S. Pat. No. 3,224,730 and British Patent No. 1,332,498 describe devices for converting the pushing action of hydraulic rams into a pulling action. Although such devices have served the purpose, they have not proved entirely satisfactory under all conditions of service.

It is, therefore, an object of the present invention to provide a push to pull force converter for use with conventional piston-cylinder units or assemblies.

Another object is to provide such a converter apparatus wherein the piston-cylinder units can be remotely controlled by the operator.

A further object of the invention is the provision of such a converter which requires little maintenance and cleaning.

Still another object is to provide such a converter which is relatively small and light weight and which requires little space for storage.

Yet another object of the present invention is the provision of such a converter which reduces or eliminates the necessity for use of additional complex and expensive equipment.

Additional objects and advantages of the invention will be set forth in part in the description which follows, and in part will be obvious from the description, or may be learned by practice of the invention. The objects and advantages are realized and attained by means of the instrumentalities and the combinations particularly pointed out in the appended claims.

To achieve these and other objects the present invention provides apparatus for converting the pushing action of a hydraulic piston-cylinder assembly to a pulling action, the apparatus comprising first means for attachment to a stationary reference object and defining first and second substantially parallel rails connected together adjacent to first ends thereof, second means for attachment to a work piece or the object to be moved and defining first and second substantially parallel bars, the second means further including guide means connecting together the bars and in operative relationship with the bars and the rails for slidably positioning and guiding the first rail and the first bar in face-to-face relationship with respect to each other and for slidably positioning and guiding the second rail and the second bar in face-to-face relationship with respect to each other, and piston-cylinder assembly receiving means in operative relationship with the first means and with the second means for receiving and supporting a conventional piston-cylinder assembly or unit and for enabling the first and second means to move relative to one another to shorten the combined length of the first and second means in response to a pushing action of the piston-cylinder assembly.

It is to be understood that both the foregoing general description and the following detailed description are exemplary and explanatory but are not restrictive of the invention.

The accompanying drawings, which are incorporated in and constitute a part of this specification, illustrate an example of a preferred embodiment of the invention and together with the description, serve to explain the principals of the invention.

Figures 1, 2, 3, 4:
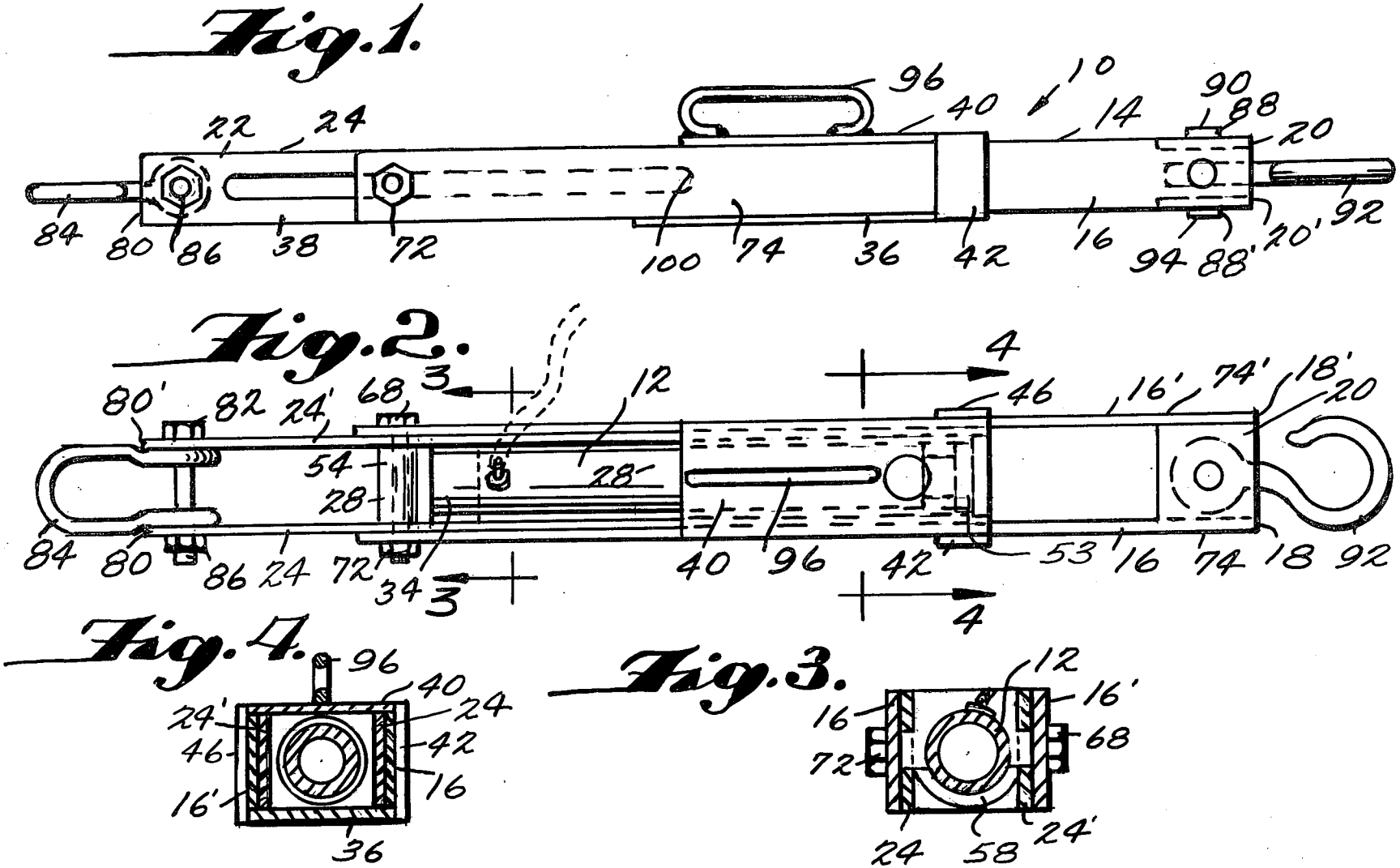
FIG. 1 is a side elevation view of the apparatus of this invention.
FIG. 2 is a top plan view of the apparatus.
FIG. 3 is a cross sectional view of the apparatus taken along the line 3—3 in FIG. 2 and looking in the direction of the arrows.
FIG. 4 is a cross sectional view of the apparatus taken along the line 4—4 in FIG. 2 and looking in the direction of the arrows.
Figure 5:
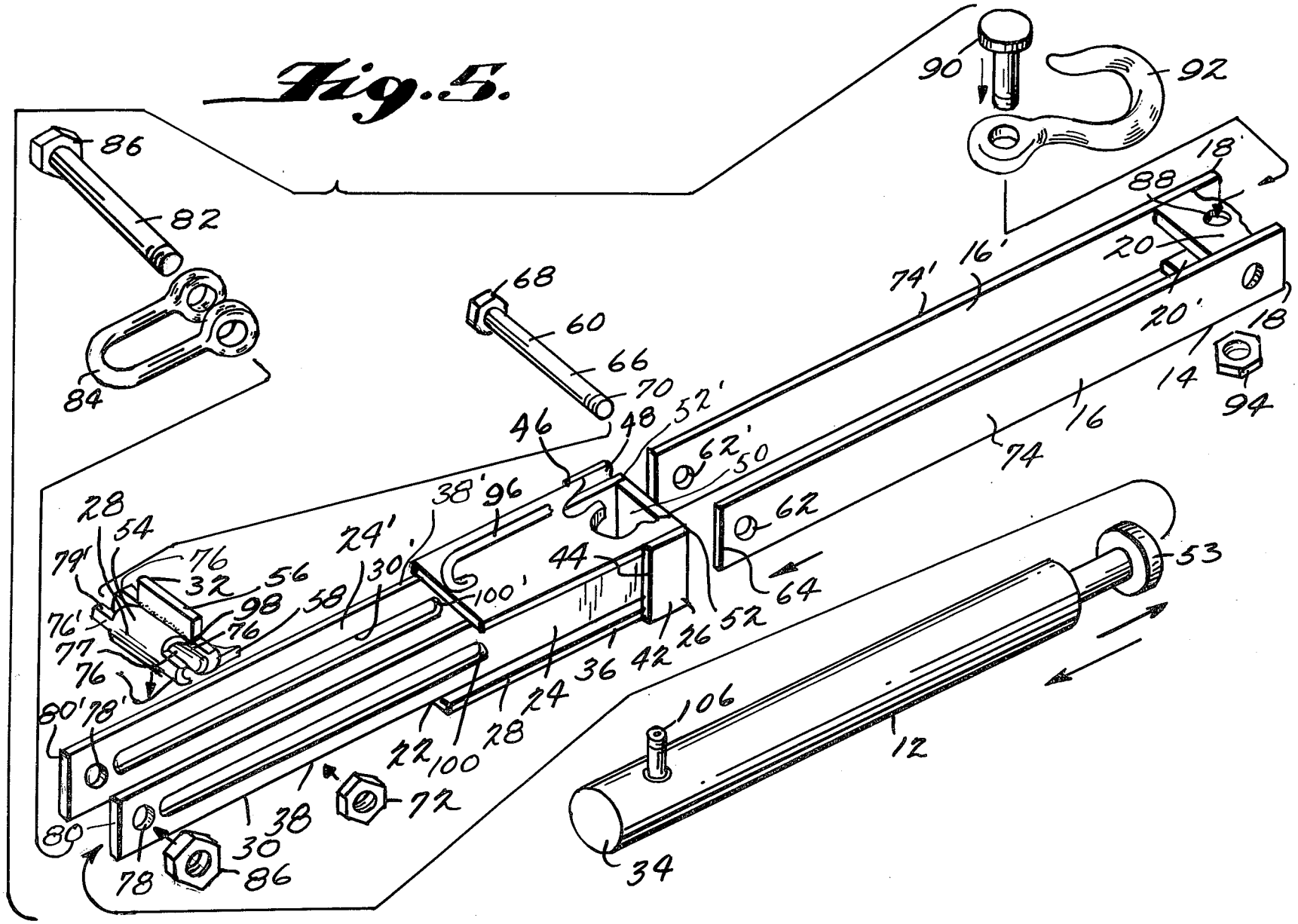
FIG. 5 is an exploded perspective view of the apparatus.

With reference now to the drawings, wherein like reference characters designate like or corresponding parts throughout the several views, there is shown apparatus 10 in accordance with this invention for converting the pushing action of a conventional hydraulic piston-cylinder assembly or unit 12 to a pulling action.

Apparatus 10 includes first means 14 for attachment to a stationary object or reference (not shown) and defining first and second substantially parallel rails 16, 16' connected together adjacent first ends 18, 18' thereof by means of connecting members 20, 20'.

Apparatus 10 further includes second means 22 for attachment to a work piece or object to be moved (not shown) and defining first and second substantially parallel bars 24, 24'. Second means 22 further includes guide means 26 connecting bars 24, 24' together and in operative relationship with bars 24, 24' and with rails 16, 16' for slidably positioning and guiding first rail 16 and first bar 24 in face-to-face relationship with respect to each other and for slidably positioning and guiding second rail 16' and second bar 24' in face-to-face relationship with respect to each other.

Apparatus 10 further includes piston-cylinder assembly receiving means 28 in operative relationship with first means 14 and with second means 22 for receiving and supporting a conventional piston-cylinder unit or assembly 12 and for enabling first means 14 and second means 22 to move relative to one another to shorten the combined length of first means 14 and second means 22 in response to the pushing action of piston-cylinder unit 12.

In accordance with the invention, bars 24, 24' define opposed, elongated slots 30, 30', and piston-cylinder assembly receiving means 28 include a support structure 32 attached to rails 16, 16', slidably positioned within slots 30, 30', and located between bars 24, 24' for receiving a first end 34 of piston-cylinder unit 12.

Guide means 26 include a lower plate member 36 connecting together bars 24, 24' and extending beyond outer faces 38, 38' of bars 24, 24'. Guide means 26 further include an upper plate member 40 connecting together bars 24, 24' and extending beyond outer faces 38, 38' of the bars. Guide means 26 further include a first guide plate 42 connected between upper plate member 40 and lower plate member 36 and positioned in spaced apart and substantially parallel relationship with first bar 24 to form a first receiving space 44 between bar 24 and guide plate 42 for receiving rail 16.

Guide means 26 similarly include a second guide plate 46 connected between upper plate member 40 and lower plate member 36. Guide plate 46 is positioned in spaced apart and substantially parallel relationship with respect to second bar 24' to form a second receiving space 48 between bar 24' and guide plate 46 for receiving rail 16'.

Piston-cylinder assembly receiving means 28 further includes an end plate 50 connecting together bars 24, 24' adjacent first ends 52, 52' thereof, and end plate 50 extends between bars 24, 24' to contact a second end 53 of piston-cylinder unit 12.

Support structure 32 includes a hollow tubular member 54 extending between bars 24, 24' and slidably positioned within slots 30, 30'. A support structure plate 56 is attached to tubular member 54 and is positioned between bars 24, 24' in substantially perpendicular relationship with respect to the bars. A support member 58 is attached to plate 56 and projects from plate 56 toward end plate 50. Means 60 extend through hollow tubular member 54 in operative relationship with rails 16, 16' for attaching support structure 32 to rails 16, 16'.

Rails 16, 16' each define an opening 62, 62', respectively, adjacent second ends 64, 64' thereof. Attaching means 60 preferably include a first bolt 66 having a head 68 at one end and threaded at the other end 70 thereof. Bolt 66 extends through the interior of hollow tubular member 54 and through rail openings 62, 62', and first nut 72 is threaded onto bolt 66 so that nut 72 rests against outer face 74 of rail 16.

Support member 58 is preferably substantially half-round in shape for receiving and supporting end 34 of piston-cylinder assembly or unit 12 in contact with support structure plate 56.

Hollow tubular member 54 defines projections 76, 76' at the ends of tubular member 54, and each of projections 76, 76' define substantially parallel flat surfaces 77 which are slidably positioned within slots 30, 30', respectively.

Bars 24, 24' define openings 78, 78' adjacent second ends 80, 80' of the bars. A first threaded pin member 82 extends between bars 24, 24' and through bar openings 78, 78'. A work fastening member 84, such as a clevis, is attached to pin member 82, and additional nuts 86 are threaded onto pin member 82 for retaining the pin member in position within bar openings 78, 78'.

In accordance with a preferred embodiment of the invention, connecting members 20, 20' define bolt-receiving openings 88, 88', and a second threaded bolt 90 extends through bolt-receiving openings 88, 88'. A stationary object or reference fastening member 92 is attached to bolt 90. A second nut 94 is threaded onto bolt 90 for retaining the bolt in position within openings 88, 88', In order to simplify carrying and storage of apparatus 10, a handle 96 is attached to upper plate number 40.

Apparatus 10 is cut, machined, welded and fitted primarily from cold rolled steel, and is preferably bolted and pivoted with number eight grade retainers.

In operation, support structure 32 is inserted into position by manually spreading apart bars 24, 24'. Projections 76, 76' of tubular member 54 are positioned within slots 30, 30' with parallel flat surfaces 77, 77' slidably positioned within the slots. Attachment means 14 is then positioned by sliding rails 16, 16' through receiving spaces 44, 48 and by moving attachment means 14 toward second ends 80, 80' of bars 24, 24' until rail openings 62, 62' are aligned with opening 98 of hollow tubular member 54. Bolt 66 is then inserted through opening 98, through slots 30, 30' and through rail openings 62, 62'. Nut 72 is then tightened onto threaded end 70 of bolt 66 until nut 72 is tightened against outer face 74 of rail 16. Head 68 of bolt 66 will rest against outer face 74' of rail 16'. Support member 58 is positioned to project from plate 56 toward end plate 50.

In this assembled configuration, apparatus 10 permits relative movement between first attachment means 14 and second attachment means 22. Those portions of plate members 36, 40 which extend beyond outer faces 38, 38' of bars 24, 24' act as supports and guides for rails 16, 16' to enable rails 16, 16' and bars 24, 24' to move in parallel relationship and adjacent to each other in face-to-face relationship.

Piston-cylinder assembly or unit 12 is inserted into apparatus 10 so that a first end 34 of unit 12 rests on support member 58 and in abutting relationship with support structure plate 56. Second end 53 of unit 12 is positioned on lower plate 36 and with second end 53 contacting end plate 50.

Fastening member 92 is connected to a stationary object or reference (not shown), and fastening member or clevis 84 is attached to the object to be moved or the work piece. When so connected, apparatus 10 is extended in its overall length by sliding support structure 32 toward first ends 100, 100' of slots 30, 30', respectively.

Piston-cylinder unit 12 is provided with a conventional pump (not shown) which is controlled by a handle (not shown). A conventional flexible tube 106 is connected between the pump and hydraulic unit 12, and tube 106 may be long enough to permit remote operation of apparatus 10.

As the pump is operated by its handle, hydraulic unit 12 increases in length. This, in turn, causes unit 12 to act against plate 56 at one end and against end plate 50 at the other end so that the overall length of apparatus 10 is reduced and a pulling action is provided between the stationary object or reference and the work piece.

Various sizes and weights may be provided for apparatus 10 in order to provide different levels of pulling force. Additional clamps, pull plates, chains and other conventional devices may be needed to effectively repair vehicle body or chassis damage. The vehicle must also be securely retained in a conventional manner, either by using a frame rack (not shown) or anchor pots (not shown) in a concrete floor, depending upon the severity of the damage to the vehicle. Frequently, numerous "pulls" are made, usually simultaneously and of different forces. Thus, more than one apparatus 10 may be necessary to repair a damaged vehicle.

Besides using the apparatus of this invention for the repair of vehicles, it can also be applied to operations in fire and rescue units, construction shops, earth moving equipment shops, and mining, milling and manufacturing operations.

The invention in its broader aspects is not limited to the specific details shown and described, and departures may be made from such details without departing from the principles of the invention and without sacrificing its chief advantages.

What is claimed is:

1. Apparatus for converting the pushing action of a hydraulic piston-cylinder assembly to a pulling action, said apparatus comprising:

first means for attachment to a reference and defining first and second substantially parallel rails connected together adjacent first ends thereof;

second means for attachment to a workpiece and defining first and second substantially parallel bars, said bars defining first and second opposed elongated slots;

said second means further including guide means connecting together said bars and in operative relationship with said bars and said rails for slidably positioning and guiding said first rail and said first bar in face-to-face relationship with respect to each other and for slidably positioning and guiding said second rail and said second bar in face-to-face relationship with respect to each other;

piston-cylinder assembly receiving means in operative relationship with said first means and with said second means for receiving and supporting a piston-cylinder assembly and for enabling said first and second means to move relative to one another to shorten the combined length of said first and second means in response to a pushing action of said piston-cylinder assembly, and wherein said piston-cylinder assembly receiving means include a support structure attached to said rails, slidably positioned within said slots and located between said bars for receiving one end of said piston-cylinder assembly.

2. Apparatus as in claim 1 wherein said guide means include a lower plate member connecting said bars together and extending beyond outer faces of said bars, an upper plate member connecting said bars together and extending beyond said outer faces, a first guide plate connected between said upper and lower plate members and positioned in spaced apart and substantially parallel relationship with said first bar to form a first receiving space between said first bar and said first guide plate for receiving said first rail, and a second guide plate connected between said upper and lower plate members and positioned in spaced apart and substantially parallel relationship with said second bar to form a second receiving space between said second bar and said second guide plate for receiving said second rail.

3. Apparatus as in claim 2 wherein said piston-cylinder assembly receiving means further include an end plate connecting said bars together adjacent first ends thereof and positioned to contact a second end of said piston cylinder assembly.

4. Apparatus as in claim 3 wherein said support structure includes a hollow tubular member extending between said bars and slidably positioned within said slots, a support structure plate attached to said tubular member and positioned between said bars in substantially perpendicular relationship with said bars, a support member attached to said support structure plate and projecting from said support structure plate toward said end plate, and means extending through said hollow tubular member and in operative relationship with said rails for attaching said support structure to said rails.

5. Apparatus as in claim 4 wherein said support member is substantially half-round in shape for receiving and supporting a first end of said piston-cylinder assembly in contact with said support structure plate.

6. Apparatus as in claim 5 wherein said rails each define openings adjacent second ends thereof, said attaching means including a first bolt having a head at one end and threaded at the other end thereof and extending through said hollow tubular member and through said rail openings, and a first nut threaded onto said bolt.

7. Apparatus as in claim 6 wherein said hollow tubular member defines projections at each end thereof, each of said projections defining substantially parallel flat surfaces slidably positioned wtihin said slots.

8. Apparatus as in claim 7 wherein said bars each define openings adjacent second ends thereof, a first threaded pin member extending between said bars and through said bar openings, a work fastening member attached to said pin member, and additional nuts threaded onto said pin for retaining said pin in position within said bar openings.

9. Apparatus as in claim 8 wherein said first means further include at least one connecting member connecting said rails together adjacent said first ends thereof, said connecting member defining a bolt-receiving opening, a second threaded bolt extending through said bolt-receiving opening, a reference fastening member attached to said second bolt, and a second nut threaded onto said second bolt for retaining said second bolt in position within said bolt receiving opening.

10. Apparatus as in claim 9 further including a handle attached to said upper plate member.

* * * * *